US005514058A

United States Patent [19]

Buoni et al.

[11] Patent Number: 5,514,058

[45] Date of Patent: May 7, 1996

[54] PORTABLE WHOLE BODY EXERCISE DEVICE

[75] Inventors: Nick Buoni, 5074 Whitehall, Memphis, Tenn. 38117; Willis Jordan, Birmingham, Ala.

[73] Assignee: Nick Buoni, Memphis, Tenn.

[21] Appl. No.: 372,765

[22] Filed: Jan. 13, 1995

[51] Int. Cl.[6] ..... A63B 21/02

[52] U.S. Cl. ..... 482/124; 482/125; 482/126; 482/44; 482/49

[58] Field of Search ..... 482/121, 122, 482/124, 125, 126, 44, 49

[56] References Cited

U.S. PATENT DOCUMENTS

| | | | |
|---|---|---|---|
| 2,590,951 | 4/1952 | Farison . | |
| 2,930,614 | 3/1960 | McIntosh | 482/126 |
| 3,531,113 | 9/1970 | Sherman et al. . | |
| 3,544,106 | 12/1970 | Barrett | 482/126 |
| 3,633,908 | 1/1972 | Krauth | 482/126 |
| 3,807,730 | 4/1974 | Dalton et al. . | |
| 4,059,265 | 11/1977 | Wieder et al. . | |
| 4,090,706 | 5/1978 | Reda . | |
| 4,195,835 | 4/1980 | Hinds et al. . | |
| 4,540,173 | 9/1985 | Hopkins . | |
| 4,609,191 | 9/1986 | Remme . | |
| 4,789,154 | 12/1988 | Mattox | 482/126 |
| 5,031,906 | 7/1991 | Janc | 482/126 |
| 5,131,650 | 7/1992 | Hall | 482/126 |
| 5,199,936 | 4/1993 | Moye | 482/126 |

OTHER PUBLICATIONS

*Fitness Systems,* Marcy Wedge Plus, p. 13 (1990–1991).
*Fitness Systems,* Chest Expander With Shock Cord, p. 14 (1990–1991).
*Enrichments,* Thera–Band, p. 3 (1993).
*Enrichments,* Thera–Band Plus, p. 4 (1993).
*Self Care Catalog,* Belly Flattener, Order #A2742 (Autumn 1993).
*Self Care Catalog,* Powerlines Total Body Workout, Order #A3123 (Autumn 1994).
Men's Health, EZ Krunch Abdominal Exerciser (June 1994).
*Home Health Products,* Can–Do Exercise Bands, Order #117 (Jan./Feb. 1995).
*Therapeutic Dimensions,* Pul–Ez, Thera–Loop and Range Master (1992).
*Hammacher Schlemmer Catalog,* Total Body Gym, Order #52516M (Summer 1994).
*Muscle And Fitness,* Gripmaster, p. 271 (Jul. 1994).

*Primary Examiner*—Lynne A. Reichard
*Attorney, Agent, or Firm*—Wood, Herron & Evans

[57] ABSTRACT

A portable whole body exercise device is disclosed that utilizes a rigid hollow tube and two elastic cords that may have different tensions. One elastic cord runs lengthwise through the hollow tube, while the second elastic cord is connected between the open ends of the tube.

17 Claims, 3 Drawing Sheets

PORTABLE WHOLE BODY EXERCISE DEVICE

FIELD OF THE INVENTION

This invention relates generally to a lightweight and portable exercise device that enables a user to exercise both upper body muscles and lower body muscles to achieve a total body workout. More particularly, this invention relates to an exercise device that employs a rigid, hollow tube generally semicircular in shape, which is provided with internal and external tension cords of different strengths that enable a user to exercise different muscles in different ways.

BACKGROUND OF THE INVENTION

Over the years, many portable exercising devices employing stretchable or tension cords have been developed. However, many of these devices are designed to exercise a particular muscle group and are not adapted to a full body workout. For instance, a device for exercising the muscle groups used for drawing and holding the draw of a bow is disclosed in U.S. Pat. No. 4,609,191. That device is designed solely to work out the muscles of a user's hand and arm.

Similarly, some devices are developed for specifically exercising a user's upper body muscles such as the devices disclosed in U.S. Pat. Nos. 4,540,173 and 3,807,730, while other devices are developed for specifically exercising one's lower body muscles such as the device disclosed in U.S. Pat. No. 3,531,113.

Some devices require the use of large, awkward and hard bars as disclosed in U.S. Pat. Nos. 4,059,265 and 4, 195,853. These devices can be heavy and difficult to manipulate.

While many exercise devices utilize stretchable cords to achieve the workout, they often do so in an inefficient or limiting manner. A device disclosed in U.S. Pat. No. 4,540, 173 passes one tension cord twice through a flexible sheath. Much friction between the overlapping portions of the cord results from its use. This subjects the cord to greater wear and tear as it constantly rubs against itself, thereby reducing the durability and life of the device, and which provides only a single degree of resistance.

SUMMARY OF THE INVENTION

This invention provides a portable whole body exercise device having numerous advantages over other exercise devices. It is capable of exercising not only upper body muscles or lower body muscles, but both, including muscles in the hand and fingers. Other exercise devices generally exercise only a limited group of muscles, such as leg muscles. Another advantage of this device is that it is adaptable for use by all people of varying strengths, not just for the average person of average strength. The device can be adapted as needed to accommodate the strength of every individual user. More particularly, the device can be adjusted to accommodate the varying strengths of each muscle of each user. Therefore, the device can simultaneously accommodate stronger muscles like thigh muscles, and weaker muscles like forearm muscles.

Another advantage of this device is its small size and light weight. These characteristics make it easy for a user to transport the device if needed. Also, the device is simple to store since it can optimally be made to be pulled apart into smaller portions with little difficulty. Other devices are difficult to store because they cannot be pulled apart or broken down at all, or if so, require many complicated adjustments to do so.

The device is comprised of a rigid hollow tube having a generally semi-circular shape, such as a "U" or a "C" shape. The tube is desirably open at each end. A first stretchable elastic cord extends through the interior length of the tube and is slidable in it. The ends of the first cord extend outwardly at the respective ends of the tube. Two finger- or hand-exercising squeezable members are attached to the respective ends of this first cord. These squeezable members are adapted to be gripped in the hands of a user and squeezed to strengthen the user's grip. At the same time, the user can pull either or both members away from the tube, stretching the first cord, thereby exercising the user's intended muscles.

The device has an external second elastic cord connected between the respective ends of the tube. The second cord does not extend through the length of the tube and, preferably, has different stretching force characteristics than the first cord.

In other subsidiary aspects of the invention, the tube may comprise two separable portions removably connected at a separating joint generally along a mid-position of the tube. This joint permits a user to pull the tube apart into smaller parts for storage. The joint is a telescoping connection with the first cord passing through the joint. The first and second cords may be removably connected to the respective ends of the tube.

In another aspect of the invention, the second cord is encased along part of its length by a larger diameter foam sheath, making it easier for a user to grip. In an alternative embodiment of the invention, the rigid hollow tube is also encased by a larger diameter foam sheath, making the device easier to grip, stand on, or more comfortable to bear against the body, and safer to use.

In another aspect of the invention, a foam member surrounds a middle portion of the tube for supporting the tube in a vertical position on the floor so that it can be held down by the user. In still another aspect of the invention, the tube has two hand grips near each of its ends.

The device can be used to exercise arm muscles. For example, bicep curls or tricep extensions can be performed using this device. Finger, hand and forearm muscles can also be exercised by this device. Leg extensions and lifts can be done to exercise thigh and calf muscles. Various chest presses can be performed to exercise chest muscles also. Other muscles such as the shoulder muscles can likewise be exercised.

Additional objects, advantages, and novel features of the invention will be set forth in part in the description which follows, and others will become apparent to those skilled in the art upon examination of this description. The objects and advantages of the invention may be realized and obtained by means of the instrumentalities and combinations particularly pointed out in the appended claims. The preferred embodiment is shown and described simply by way of illustration of the best mode contemplated as carrying out this invention. Accordingly, the figures and description are to be regarded as illustrative in nature and not as restrictive.

BRIEF DESCRIPTION OF THE DRAWINGS

FIG. 4A shows a user exercising arm and shoulder muscles with the exercise device of FIG. 1 while it is in a vertical position;

FIG. 4B shows a user exercising arm and shoulder muscles by using the device while holding like a bow;

FIG. 4C shows a user exercising chest muscles using the device while lying in the curvature of the rigid hollow tube;

FIG. 4D shows a user exercising leg muscles while standing up with one heel on the rigid hollow tube;

FIG. 4E shows a user exercising leg muscles with user on his side and both legs extending through the tube;

DETAILED DESCRIPTION OF THE DEVICE

Figure 1:
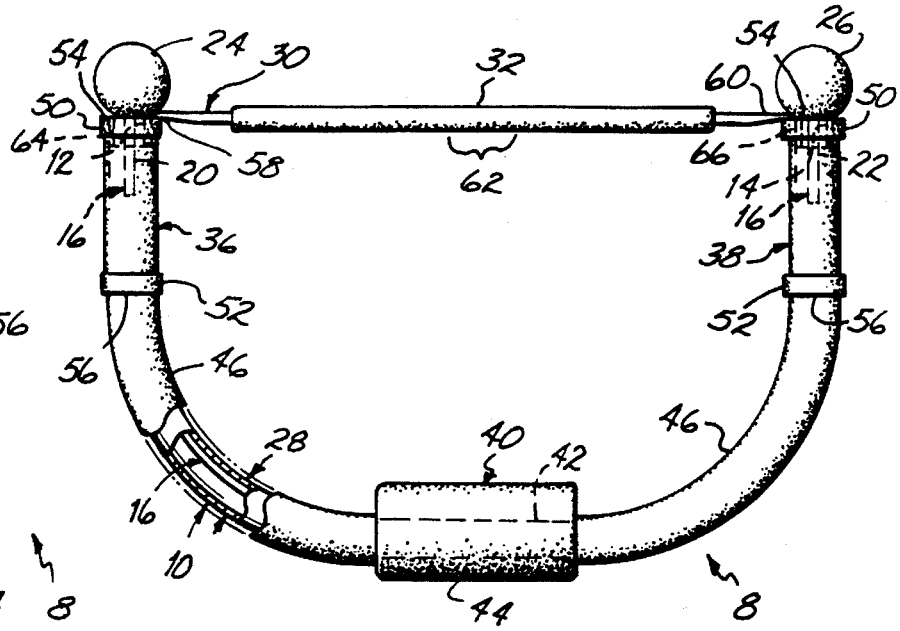
FIG. 1 is a front view of a preferred embodiment of a portable whole body exercise device in accordance with the invention.

In reference to FIG. 1, the portable whole body exercise device 8 has a rigid hollow tube 10 that is approximately semicircular in shape with open ends 12, 14. The dimensions of the curvature are such that the tube 10 will fit around the waist of a user (see FIG. 4C). A first elastic cord 16 extends through and is slidable within the interior opening of tube 10. The ends 20, 22 of cord 16 extend outwardly from respective ends 12, 14 of tube 10. When pulled, first cord 16 will slide in tube 10 because first cord 16 is smaller in diameter than the tube and there is no other sliding cord.

Figure 6:
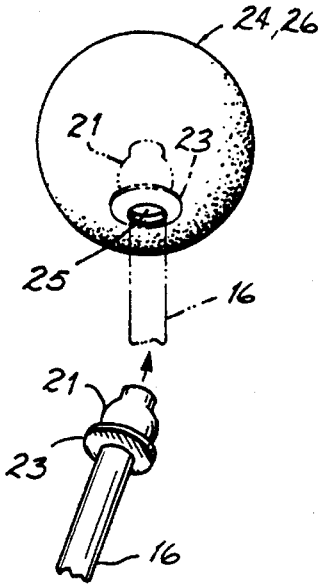
FIG. 6 is an enlarged disassembled perspective view of a cord connection.

Squeezable members 24, 26 are attached to respective ends 20, 22 of first cord 16. Squeezable members 24, 26 may be attached to first cord 16, for example by a hard, generally bulbous end fitting 21 slightly larger in diameter than first cord 16, mounted to the respective ends 20, 22 of first cord 16. As shown in FIG. 6, a washer 23 is located at base of fitting 21 where first cord 16 attaches. A fitting 21 and washer 23 can be inserted into a corresponding, generally bulbous socket 25 located on respective squeezable members 24, 26 to thus attach squeezable members 24, 26 to first cord 16. Members 24, 26 are preferably round to facilitate grasping by a user. Squeezable members 24, 26 may be solid or hollow, and comprised of a flexible material, preferably such as rubber. Members 24, 26 are adapted to be gripped and squeezed between and by the fingers of one hand to strengthen the user's grip, and to be pulled away from ends 12, 14 of tube 10 stretching first cord 16 thereby exercising the user's intended muscles. While members 24, 26 are preferably spherical, they may also be other shapes adapted to be gripped for squeezing within the hand. Members 24, 26 should be small enough to permit a user to grip the members 24, 26, yet larger than ends 12, 14 of tube 10 or larger than diameter 28 of tube 10 to prevent first cord 16 from slipping out of tube 10. Members 24, 26 may have a diameter of about 2 inches, for example, with ends of tube 10 having a diameter preferably of about 1 inch.

A second elastic cord 30 is connected under tension between open ends 12, 14 of tube 10. Second cord 30 does not extend lengthwise through tube 10. Preferably, first cord 16 and second cord 30 have different tensions (spring constant). For example, second cord 30 may have a greater tension for exercising stronger muscles, while first cord 16 may have a lesser tension for exercising weaker muscles.

Second cord 30 is preferably encased by a larger diameter foam sheath 32. This sheath 32 makes it easier for a user to grip second cord 30, and protects the user's hands from injury caused by friction created between second cord 30 and user's hands. A user can engage foam sheath 32 encasing second cord 30 and stretch second cord 30 creating greater tension on cord 30, thereby exercising the user's muscles.

Exerciser 8 has foam hand grips 36, 38 near each of open ends 12, 14 of tube 10. Grips 36, 38 facilitate the user's manipulation of tube 10 while exercising as a user can hold tube 10 securely by grips 36, 38.

Exerciser 8 has a foam member 40 surrounding a middle portion 42 of tube 10. User can place a foot on foam member 40 (see FIG. 4D) to stabilize tube 10 if necessary while exercising. Foam member 40 has a flat bottom 44 so that tube 10 can rest on it in a stable upright attitude.

Tube 10 is preferably encased by a second foam sheath 46 except where hand grips 36, 38 and foam member 40 surround tube 10. Thus, entire tube 10 is encased by hand grips 36, 38, foam member 40 at middle portion 42 of tube 10, and second foam sheath 46 such that no portion of rigid tube 10 is exposed. This protects user from being injured by rigid tube 10, while facilitating gripping by user and stabilization of exerciser 8 by user simultaneously.

Figure 2:
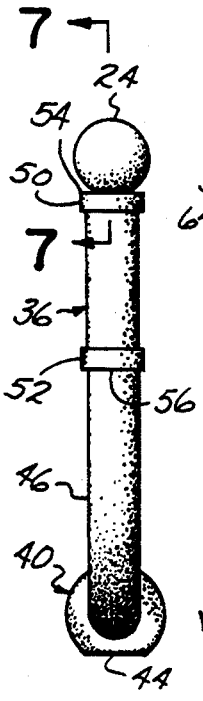
FIG. 2 is a side view of the device of FIG. 1.

With reference to FIG. 2, foam member 40 has a diameter larger than tube 10 and second foam sheath 46. Flat bottom 44 of foam member 40 makes it easier for a user to stabilize exerciser 8. Foam member 40 also makes it easier for a user to place a foot or hand or other body part on foam member 40 when stabilization is necessary for a particular exercise.

Hand grips 36, 38 completely surround tube 10 near open ends 12, 14 of tube 10. Hand grips 36, 38 have protruding flanges 50, 52 at each end 54, 56 of grips 36, 38 making it more difficult for a user's hand to slip off grips 36, 38.

Figure 3:
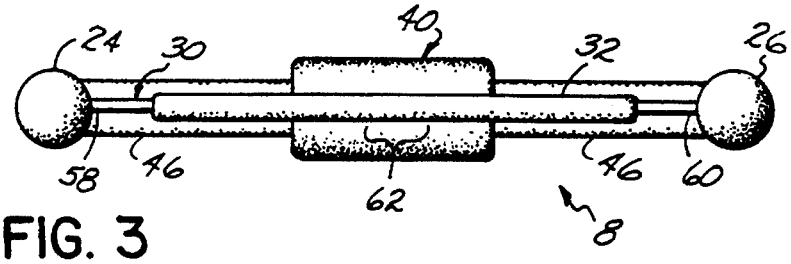
FIG. 3 is a top view of the device of FIG. 1.

With reference to FIG. 3, second cord 30 is preferably connected under tension between open ends 12, 14 of tube 10 so that second cord 30 is parallel to the ground while exerciser 8 is in a vertical position. Foam sheath 32 encases most of second cord 30 except near ends 58, 60 of second cord 30. User engages second cord 30 near a middle portion 62 of second cord 30 to produce a uniform tension along second cord 30.

Figure 7:
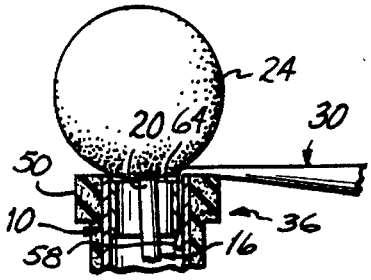
FIG. 7 is an enlarged axial cross-sectional view taken along lines 7—7 of FIG. 2.

Both squeezable members 24, 26 are located at ends 12, 14 of tube 10 adjacent to grips 36, 38. While the first cord is attached to squeezable members 24, 26 second cord 30 is not. Second cord 30 terminates and is attached at the ends 12, 14 of tube 10. Various means of attachment of second cord 30 can be used. For example, one means of attachment, illustrated in FIG. 7, is to place clamp bushings 64, 66 slightly smaller in diameter than tube 10 within open ends 12, 14 of tube 10. Each end 58, 60 of second cord 30 can be inserted between tube 10 and bushings 64, 66, after which each bushing is glued or adhered to the inside of tube 10 tightly entrapping each end 58, 60 of cord 30 therebetween.

Figure 8:
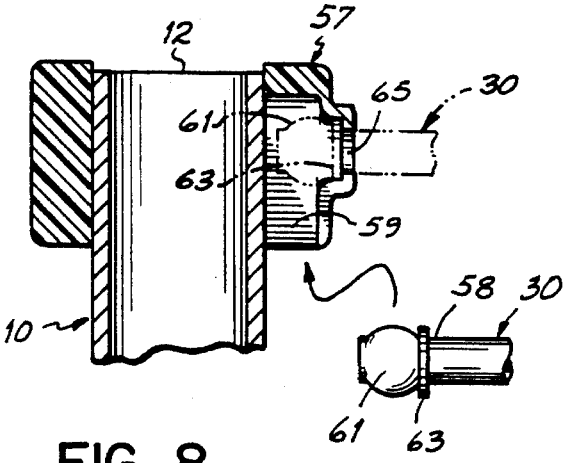
FIG. 8 is an enlarged axial cross-sectional view similar to FIG. 7 but shows an alternative cord connection.

Another means of attachment of the second cord 30 is shown in FIG. 8. A collar 57 surrounds tube 10 near respective end 12 above the hand grip (not shown), and provides a hollow cavity or socket 59, between collar 57 and tube 10. A generally hard, bulbous end fitting 61 is attached to respective end 58 of cord 30, with a washer 63 located at base of fitting 61 where second cord 30 attaches. Fitting 61 is comprised preferably of a hard plastic slightly larger in diameter than second cord 30. Fitting 61 and washer 63 can be inserted into socket 59. Second cord 30 attached to fitting 61 extends out of socket 59 through a flanged opening 65 in collar 57, thereby securing second cord 30 to exercise device 8. Second cord 30 can be released from exercise device 8 by removing fitting 61 and washer 63 from socket 59. This permits a user to alter the tension of second cord 30 by changing to a different cord.

Figure 9:
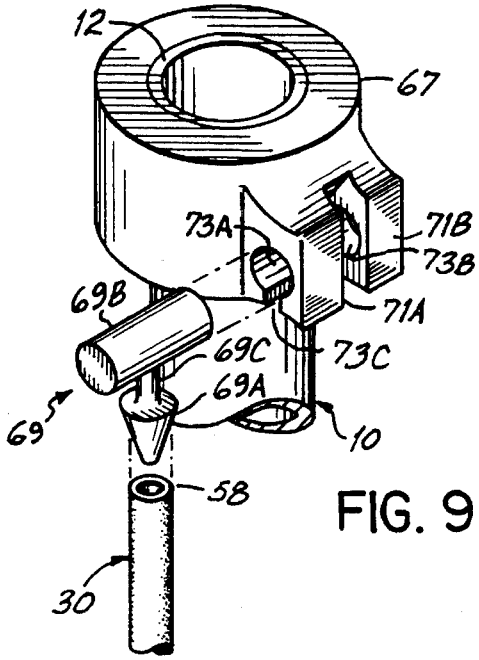
FIG. 9 is an enlarged exploded perspective view of a preferred connection for releasably attaching the second cord to the tube end, showing the cord end being connected.
Figure 10:
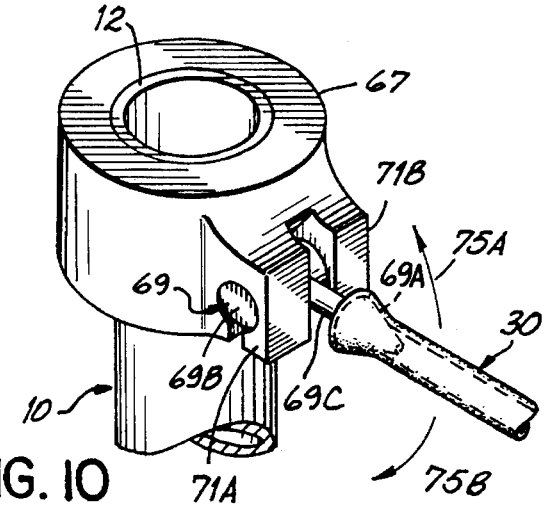
FIG. 10 is a perspective view similar to FIG. 9 but showing the second cord connected to the tube end.

Yet another means of attachment of second cord 30 is shown in FIGS. 9–10. A collar 67 is press-fitted onto tube 10 near respective end 12 above hand grip (not shown). Collar 67 is generally cylindrical in shape except for two spaced, parallel, protruding flanges 71A, 71B extending therefrom. One or both flanges 71A, 71B has an opening 73A ,73B therein, one or both of which includes a T-shaped slot 73C that will accept the narrow neck 69C of a generally hard T-shaped end fitting 69. Fitting 69 is attached to respective end 58 of cord 30. A first portion 69A of fitting 69 is shaped like an arrow having a conically shaped or barbed end that can be inserted into respective end 58 of cord 30 to securely fit therein. Fitting 69 can then be inserted or slid into opening 73A and/or 73B of flange 71A and/or 71B to attach second cord 30 to the tube. The cylindrical cross bar or second portion 69B of fitting 69 rests within openings 73A, 73B of flanges 71A, 71B while first portion 69A is centered between the flanges 71A, 71B. Thus, first portion 69A with second cord 30 attached thereto can rotate between flanges 71A, 71B as shown by the arrows 75A, 75B. User therefore is provided a vertical range of motion with second cord 30, so that pulling on second cord 30 exerts a direct pull on fitting 69, rather than an angular pull which would tend to wear the connection. User can easily change second cord 30 by removing fitting 69 from opening 73A and replacing with a different fitting attached to a different second cord. This allows a user to change the tensions at which he exercises, and therefore accommodate various muscle groups of differing strengths.

Figure 4A:
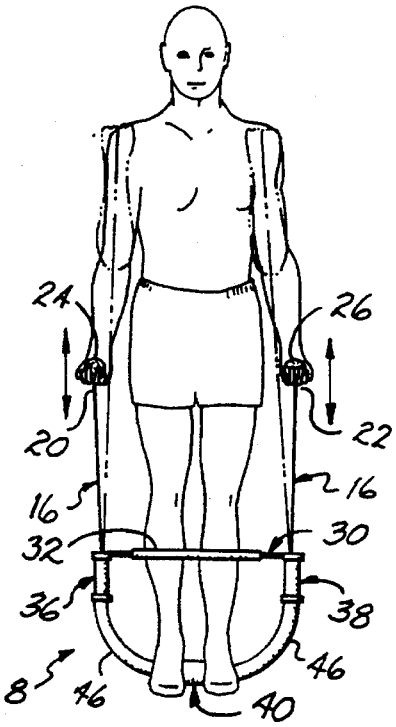
FIGS. 4A–E are a series of illustrations showing ways in which the invention can be used to exercise different muscles; more specifically.

Reference is made to FIGS. 4A–4E to illustrate the various ways to use the exercise device 8 to exercise different muscles of the body. With reference to FIG. 4A, muscles in the user's arms and shoulders can be exercised. User can grip squeezable members 24, 26 attached to first cord 16 and pull upward in different ways to exercise the various muscles of the user's arms and shoulders as the device remains in a vertical position on the ground. For example, biceps curls can be performed by grasping squeezable members 24, 26 with the user's hands, palm side facing upward, pulling upward on squeezable members 24, 26 and bending at user's elbows while user stabilizes device by standing on foam member 40 with a foot 72, Other exercises can be done to exercise remaining muscles in arms and shoulders.

Figure 4B:
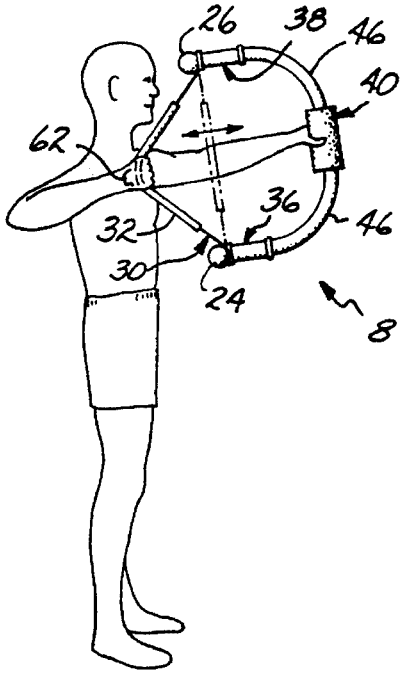

With reference to FIG. 4B, a user's arms and shoulders can be exercised by the user gripping tube 10 at middle portion 42 with one hand and simultaneously gripping second cord 30 with the other hand and pulling second cord 30 like a string on a bow.

Figure 4C:
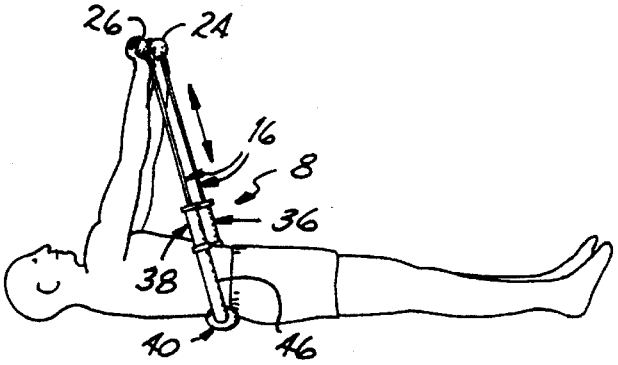

With reference to FIG. 4C, user can exercise chest muscles by placing exercise device 8 in a vertical position and lying horizontally in the curvature of tube 10 placing the user's back on foam member 40 such that tube 10 extends upward on each side of user. User is thus lying within the curvature of tube 10. User then grips squeezable members 24, 26 attached to first cord 16, or grips foam sheath 32 of second cord 30 and presses upward away from the user's body thereby exercising the user's chest muscles, User can exercise hand and arm muscles by simply squeezing the squeezable members 24, 26 attached to first cord 16.

Figure 4E:
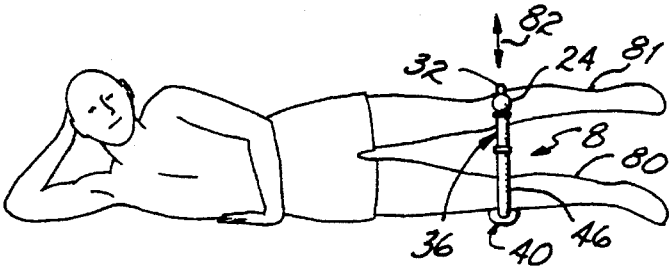
Figure 4D:
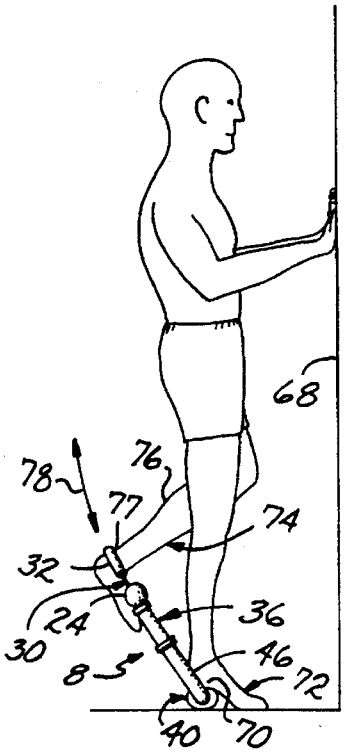

User can exercise lower body muscles also. With reference to FIG. 4D, user can place device in a vertical position near a wall 68. User then steps between device and the wall 68, faces wall 68, stabilizes self by holding on to wall 68, and places a heel 70 of one foot 72 on foam member 40 to facilitate stabilization of device. User then exercises remaining leg 74 by engaging second cord 30 with calf muscle 76 or back of heel 77 near Achilles tendon (not shown), thereby lifting second cord 30 upward in direction of arrows 78.

User can exercise thigh muscles also. With reference to FIG. 4E, user can lay on his side (or his back if preferred). User places exercise device 8 in a vertical position and stabilizes the device by placing one leg 80 on foam member 40. With remaining leg 81, user engages second cord 30 to side of user's ankle, shin, or knee area, and lifts second cord 30 upward in the direction of arrow 82.

Figure 5:
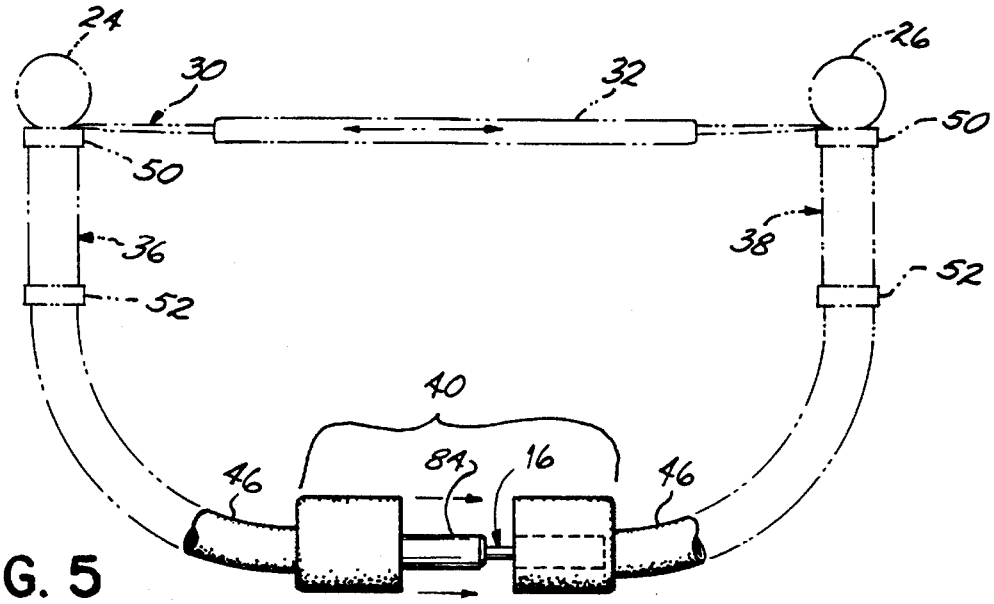
FIG. 5 is an exploded front view of an alternative embodiment of the exercise device, having a telescoping joint between two halves, and separated into two halves.

There are many other methods to use the exercise device to achieve a full body workout. FIGS. 4A–4E are illustrative in nature and not exclusive in any manner. After completing the workout and with reference to FIG. 5, user can pull apart tube 10 at its separating joint 84 along a mid position 42 of tube 10. Tube 10 pulls apart into two halves for easy storage, without having to remove first cord 16 or second cord 30. The separating joint 84 is preferably telescoping such that the two halves slide succinctly together. However, any joint succinctly joining the halves of tube will suffice.

By virtue of the foregoing, there is thus provided a portable full body exercise device that is light weight and easy to use. While the present invention has been illustrated by the description of embodiments thereof, and while the embodiments have been described in considerable detail, it is not the intention of the applicants to restrict or in any way limit the scope of the appended claims. Additional advantages and modifications will readily appear to those skilled in the art. The invention in its broader aspect is, therefore, not limited to the specific details and illustrative examples shown and described. Departures may be made from such details without departing from the spirit or scope of applicant's general inventive concept.

What is claimed is:

1. A portable exercise device comprising:

(a) a rigid hollow tube having generally a semicircular shape and two ends;

(b) a first elastic cord extending through and slidable in said tube, having ends extending outwardly from the respective said ends of said tube;

(c) two resiliently squeezable finger and hand exercising members attached to the respective ends of said first cord, said members being adapted to be gripped in the hands of a user and squeezed to strengthen the user's grip, by pulling either said member away from said tube and stretching said first cord and exercising the user's intended muscles; and (d) a second elastic cord connected between said ends of said tube, said second cord not extending lengthwise through said tube.

2. The portable exercise device of claim 1 wherein said tube comprises two separable parts which are separably connected to one another at a joint generally along a mid-position of said tube, whereby a user can separate said tube apart into smaller parts for storage without removing either of said cords from said tube, said first cord passing through said joints.

3. The exercise device of claim 2 wherein said joint is telescoping.

4. The portable exercise device of claim 1 wherein said second cord is encased by a larger diameter foam sheath which makes it easier for a user to grip.

5. The portable exercise device of claim 1 wherein a member surrounds a middle portion of said tube for supporting said tube in a vertical position.

6. The portable exercise device of claim 1 wherein said tube has a hand grip near each of its said ends.

7. The portable exercise device of claim 1 wherein said tube is encased by a larger diameter foam sheath.

8. The portable exercise device of claim 1 wherein said second cord is removably connectable to said ends of tube.

9. The portable exercise device of claim 1 wherein said first cord is removably connected to said finger and hand exercising members.

10. The portable exercise device of claim 1 wherein said second cord has different stretching force characteristics than said first cord.

11. The exercise device of claim 1 wherein the second cord is connected between respective said ends of the tube by inserting and entrapping a respective end of said second cord between the tube and a bushing located within respective said ends of the tube.

12. The exercise device of claim 1 further comprising a collar surrounding respective said ends of tube wherein said collar provides a hollow cavity between the collar and said tube.

13. The exercise device of claim 12 wherein the second cord is connected between the ends of said tube by bulbous fittings on the ends of said second cord which are inserted into the respective hollow cavities of said collar.

14. The exercise device of claim 1 further comprising a collar surrounding respective said ends of tube wherein said collar has two spaced flanges protruding therefrom.

15. The exercise device of claim 14 wherein one or both of said flanges has an opening which rotatably receives a fitting at the end of said second cord.

16. The exercise device of claim 15 wherein said fitting is T-shaped and wherein one or both of said openings has a T-slot therein to releasably receive said fitting.

17. The exercise device of claim 16 wherein the second cord is connected between the respective ends of said tube by T-shaped end fittings attached to the ends of said second cord and inserted into the said opening, with a T-slot of one or both said flanges protruding from said collar.

* * * * *

UNITED STATES PATENTS AND TRADEMARK OFFICE

CERTIFICATE OF CORRECTION

PATENT NO. : 5,514,058
DATED : May 7, 1996
INVENTOR(S) : Buoni et al.

It is certified that error appears in the above-identified patent and that said Letters Patent is hereby corrected as shown below Column 6, Line 34, please add the numeral "10" after the word --tube--.

Signed and Sealed this

Eighth Day of April, 1997

Bruce Lehman

*Attest:*

BRUCE LEHMAN

*Attesting Officer*

*Commissioner of Patents and Trademarks*